United States Patent [19]

Blackburn, deceased

[11] 4,169,348

[45] Oct. 2, 1979

[54] FIBRE OPENING APPARATUS FOR AN OPEN-END SPINNING MACHINE

[75] Inventor: Reginald M. Blackburn, deceased, late of Accrington, England, by Althea Blackburn, personal representative

[73] Assignee: Platt Saco Lowell Limited, Great Britain

[21] Appl. No.: 918,194

[22] Filed: Jun. 22, 1978

[30] Foreign Application Priority Data

Jun. 22, 1977 [GB] United Kingdom ..... 26018/77

[51] Int. Cl.[2] ..... D01H 1/12

[52] U.S. Cl. ..... 57/58.91; 19/112

[58] Field of Search ..... 57/58.91–58.95; 19/97, 112, 114

[56] References Cited

U.S. PATENT DOCUMENTS

| | | | |
|---|---|---|---|
| 3,624,997 | 12/1971 | Didek et al. | 57/58.91 |
| 3,750,382 | 8/1973 | Minami et al. | 57/58.91 |
| 3,978,646 | 9/1976 | Hoffman et al. | 57/58.91 X |
| 4,058,965 | 11/1977 | Shaw et al. | 57/58.91 |

*Primary Examiner*—Donald Watkins

*Attorney, Agent, or Firm*—Donald H. Feldman

[57] ABSTRACT

A fibre opening apparatus for an open-end spinning machine includes a housing provided with a recess in which is mounted for rotation a fibre opening roller. The peripheral surface of the opening roller co-operates with a fibre locating surface defined by the recess to form a fibre-conveying passage. The tips of each of a plurality of needles protruding from the peripheral surface terminates in an imaginary cylindrical surface and at equal distances from the fibre locating surface. The generatrix of the peripheral surface is concave.

Preferably, the opening roller has lateral side flanges and the generatrix is formed by an arc extending between the inner surfaces of the flanges and derived from a common radius. The chord of the arc may be co-incident with the generatrix of the imaginary cylindrical surface.

The generatrix of the peripheral surface may be formed by an arcuate central region which is joined to the inner surfaces by arcuate side regions.

The generatrix may be formed by a straight central region which is joined to the inner surfaces by inclined side regions.

11 Claims, 6 Drawing Figures

FIBRE OPENING APPARATUS FOR AN OPEN-END SPINNING MACHINE

BACKGROUND OF THE INVENTION

This invention relates to improvements in apparatus for open-end spinning textile yarns and more particularly to the fibre-opening zone of such apparatus in which a sliver supplied thereto is subjected to an opening operation.

In one known method of open-end spinning a sliver is forwarded to a rotating opening roller provided with needles or saw-tooth type teeth projecting from a peripheral surface thereof so as to separate and open the fibres from the sliver. The fibres are then conveyed on the peripheral surface of the opening roller to the entrance of a fibre feed duct through which they are transported to the inside of a spinning rotor.

The opening roller is mounted for rotation in a circular recess formed in a housing. The recess has a diameter slightly larger than the diameter of the opening roller when measured over the tips of the needles or saw-tooth type teeth. The peripheral surface of the opening roller is normally cylindrical in form and defines with the parallel adjacent surface of the recess and with the inner surfaces of lateral flanges, which are normally provided at each side thereof, a fibre conveying passage of rectangular cross-section. Such arrangements are disclosed in U.S. Pat. No. 3,828,539 and U.S. Pat. No. 4,058,965.

In operation, it has been found that a fibre-conveying passage of rectangular cross-sectional shape does not provide the optimum fibre opening conditions. In particular, it has been found that the fibrous material tends to transfer from the fibre-conveying passage over the flanges into the lateral clearances between the side surfaces of the opening roller and the adjacent surfaces of the housing. Accumulation of fibrous material in these clearances can become so acute as to impair rotation of the opening roller with consequent danger of damage to the opening roller components and interruption of the spinning process.

In U.S. Pat. No. 3,750,382 there is disclosed an opening system in which the supply sliver is opened by a first opening roller and then further opened by a second opening roller. In FIG. 10 various forms of the opening roller peripheral surface and the adjacent recess surface combine to provide different shapes of the fibre conveying passage. In FIGS. 10*c* and 10*d* the radial distances between the opening roller peripheral surfaces and the adjacent recess surfaces are greater at the mid-points than at the sides. Each of the tips of the fibre opening teeth protrude from the peripheral surface by equal amounts. Such arrangements have been devised to overcome an excessive combing action tending to damage the fibres which, according to the specification, had been experienced with fibre conveying passages of rectangular shape.

Such arrangements, however, would not provide a satisfactory fibre opening operation. The wide, varying, radial gap between the tips of the teeth and the recess surface results in insufficient opening of the fibrous material, since the fibres tend to accumulate against the recess surface due to centrifugal forces without being acted upon by the teeth. In these circumstances the fibres tend to be rolled into ball-like masses of fibres which will disrupt the spinning process, or at least detrimentally affect the yarn properties, if they reach the fibre collecting surface. Furthermore, because of the lack of fibre control in this known arrangement the problem of transfer of fibres from the fibre conveying passage to the sides of the opening roller would not be overcome.

A similar arrangement is disclosed in Japanese Patent Publication No. 75-35138 which is alleged to overcome the problem of damage to the fibres. However, all the aforementioned disadvantages will also be encountered with this arrangement, thus rendering it unsatisfactory.

SUMMARY OF THE INVENTION

It is an object of this invention to provide apparatus for opening fibres from a sliver in an open-end spinning machine which, in operation, provides improved fibre opening conditions and, in particular, reduces the tendency for fibrous material to transfer from the fibre conveying passage into the lateral clearances between the sides of the opening roller and the adjacent surfaces of the housing.

The foregoing objects are achieved by providing apparatus for opening fibres in an open-end spinning machine, comprising a housing, a recess formed in the housing so as to define a fibre locating surface, an opening roller mounted for rotation in the recess whereby to open fibres from a sliver fed thereto, the opening roller having a peripheral surface co-operating with the fibre locating surface to define therewith a fibre conveying passage, a plurality of teeth protruding from the peripheral surface of the opening roller into the fibre conveying passage such that each of the tips thereof terminates in an imaginary cylindrical surface and equi-distant from the fibre locating surface, wherein the generatrix of the peripheral surface is concave so that the radial distance between the generatrix and the imaginary cylindrical surface is a maximum at a position intermediate the length of the generatrix.

Preferably the teeth are formed by needles extending through the peripheral surface of the opening roller.

The opening roller preferably has a lateral circular flange at each side of the peripheral surface, the lateral flanges having a diameter coincident with the diameter of the imaginary cylindrical surface.

The flanges have inner confronting surfaces defining the width of the fibre conveying passage, wherein the generatrix of the peripheral surface is formed by an arc extending between the inner surfaces and derived from a common radius of curvature.

DESCRIPTION OF THE PREFERRED EMBODIMENTS

Figure 1:
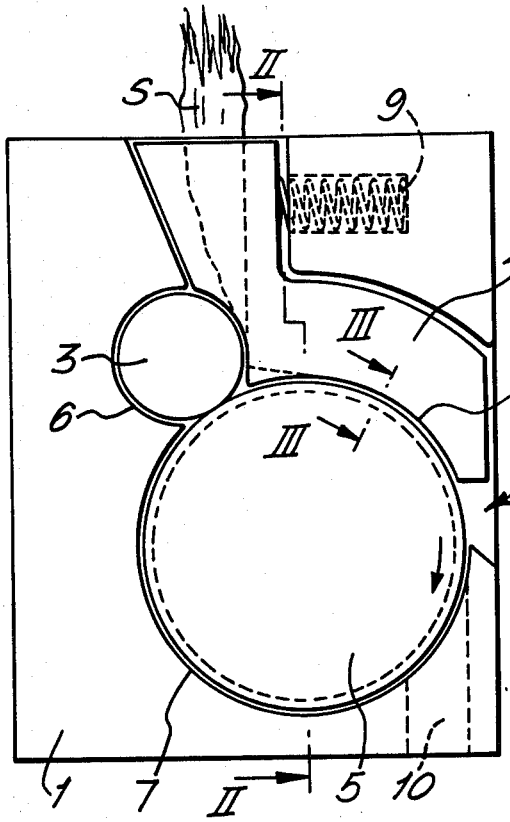
FIG. 1 is a front elevation of a fibre opening zone of an open-end spinning apparatus with a cover removed therefrom to more clearly show the fibre opening elements.

Referring to the drawings, a housing 1 is provided with a cavity 2 in which is located a rotatable sliver feed roller 3, a feed plate 4 and a rotatable opening roller 5. The cavity 2 has a first radiussed portion 6 formed so as to partly and concentrically encircle the peripheral surface of the feed roller 3 and a radiussed portion 7 formed so as to partly and concentrically encircle the opening roller 5. The feed plate 4 has a curved fibre-locating surface 8 adjacent to and so radiussed as to be concentric with the outside diameter of the opening roller 5. Thus the fibre-locating surface 8 and the radiussed portion 7 of the cavity 2 form a recess which almost completely encircles the opening roller 5. A spring 9 resiliently biases the feed plate 4 against the feed roller 3 to form a sliver forwarding nip therewith and the feed plate 4 is so mounted that the fibre locating surface 8 is constrained to move in a path concentric with the outside diameter of the opening roller 5. Details of suitable mounting arrangements for the feed plate 4 can be found in U.S. Pat. No. 3,828,539. A fibre feed outlet duct 10 provides a communication between a cavity 2 and a fibre feed passage (not shown) which serves to convey the fibres to a spinning rotor (not shown). A cover 11 is fixed to the housing 1, so as to cover the cavity 2 and the sliver feed roller 3, feed plate 4 and opening roller 5.

Figure 2:
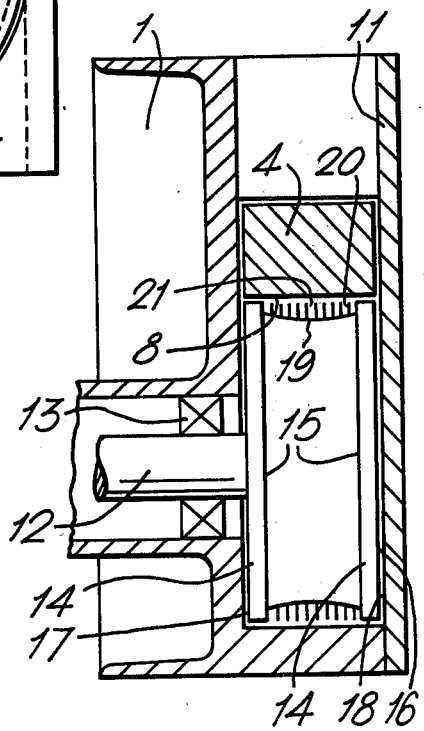
FIG. 2 is a cross-sectional side elevation on the line 11—11 of the opening zone shown in FIG. 1.
Figure 3:
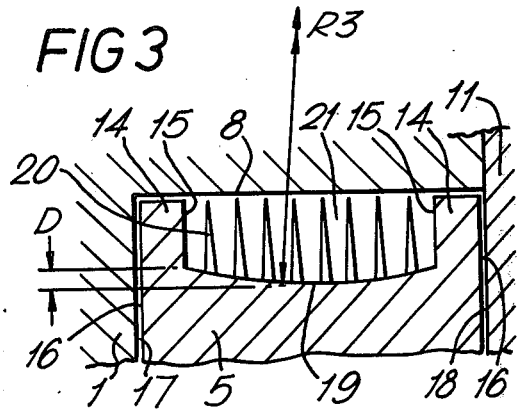
FIG. 3 is a part cross-sectional side elevation on the line 111—111 showing in greater detail the fibre conveying passage.

As best seen in FIG. 2, the opening roller 5 is fixed on the end of a shaft 12 rotatably supported by bearings 13, only one of which is shown. The shaft 12 extends rearwardly out of the housing 1 to engage a driving belt (not shown) from which rotation of the opening roller 5 is derived. Referring also to FIG. 3, the opening roller 5 has a flange 14 at either side thereof, each having an inner surface 15 and an outer surface 16. The outer surface 16 of the flanges define with the adjacent surface of the housing 1 and the cover 11 respectively, small lateral clearances 17, 18. Extending between the inner surfaces 15 of the flanges is a peripheral surface 19, from which protrude a plurality of needles 20 which form the fibre opening teeth. The needles 20 protrude through the peripheral surface 19, as shown in U.S. Pat. No. 4,058,965 into the channel bounded by the inner surfaces 15 and the peripheral surface 19. Each of the tips of the needles 20 terminate in an imaginary cylindrical surface generated by a straight line parallel to the rotational axis of opening roller 5 such that the imaginary cylindrical surface has a diameter coincident with the outside diameter of the flanges 14, whereby the needle tips are equi-distant from the fibre locating surface 8. The radius of the flanges 14 is slightly less than the radius of the fibre-locating surface 8 so that a fibre conveying passage 21 is formed, bounded by the fibre-locating surface 8, the peripheral surface 19 and at each side in axial extent by the inner surfaces 15 of the flanges 14.

In operation, a sliver S is forwarded between the nip formed by the rotating feed roller 3 and the feed plate 4 into the path of the needles 20 protruding from the peripheral surface 19 of the rotatable opening roller 5. The fibres are thus detached from the sliver S and conveyed through the fibre conveying passage 21 by the opening roller 5. The fibres are removed from the opening roller 5 at the entrance to the fibre outlet duct through which they are conveyed in an opened condition to the spinning rotor where they are collected and spun into a yarn.

Improvements in the spinning process and yarn characteristics are obtained by modifying the shape of the fibre-conveying passage 21 so that the radial distance between the peripheral surface 19 and the fibre-locating surface 8 is at a maximum position intermediate the inner surfaces 15.

With reference particularly to FIG. 3 the generatrix of the peripheral surface 19 is concave and has a radius of curvature R3 so as to produce a smooth arc between the inner surfaces 15 of the flanges 14. The radius of curvature R3 of the arc produces a chordal depth D of 0.5 mm with a chord length, i.e. the width of the peripheral surface, of approx 23 mm. Preferably the chordal depth does not exceed 1.5 mm. Thus a fibre conveying passage 21 is formed which gradually increases in depth, i.e. the radial distance between the peripheral surface 19 and the fibre locating surface 8, from the sides to a central portion thereof.

The cylindrical imaginary surface containing the tips of each of the teeth is spaced from the adjacent fibre locating surface 8 by a distance of the order of 0.15 mm such that the teeth across the full width of the roller closely coact with the fibre locating surface 8 to open and convey the fibres. In this way the formation of neps by rolling the fibres between the teeth and the fibre-locating surface 8 is avoided. It is an important aspect of fibre opening zone design to maintain a narrow clearance between the tips of the teeth 20 and the fibre locating surface 8. We have found that if this clearance exceeds 0.16 mm, the quality of open-end spun yarn deteriorates.

It will be appreciated that the fibre-locating surface 8 need not be formed on the feed plate 4 but could be formed as an integral part of the housing 1.

It has been found in operation that the invention contributes to an improved fibre opening performance and that there is a reduced tendency for fibres to transfer from the fibre conveying passage 21 into the lateral clearances 17, 18.

Figure 4:
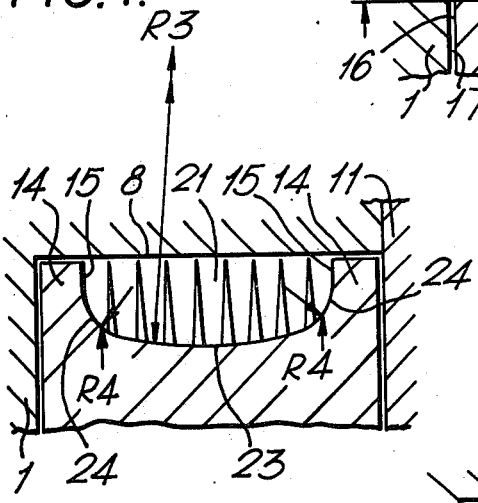
FIGS. 4, 5 and 6 are part cross-sectional side elevations showing alternative shapes of the fibre conveying passage.
Figure 5:
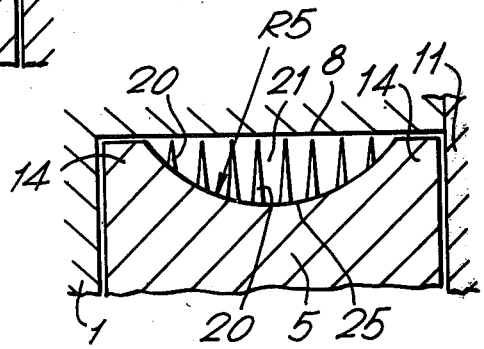
Figure 6:
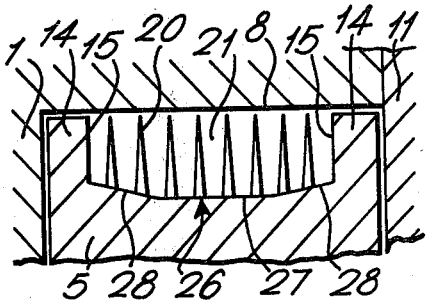

FIGS. 4, 5 and 6 show alternative forms of the peripheral surface of the opening roller 5 such that the distance between the peripheral surface 19 and the fibre conveying surface 8 is a maximum at the mid-point thereof.

In the FIG. 4 embodiment, the generatrix of the peripheral surface has an arcuate central region 23 having a radius of curvature R3 as in the FIG. 3 embodiment. This central region 23 is joined to the inner surfaces 15 by arcuate side regions 24 having a radius of curvature R4 smaller than the radius of curvature R3 of the central region. Thus the channel into which the needles 20 protrude is bounded by a smooth continuous surface devoid of sharp corners, which would, in operation provide points of fibre accumulation.

In FIG. 5, the generatrix of the peripheral surface 25 is wholly formed by an arc having a radius of curvature R5. The arc extends between the outside diameter of the flanges 14 such that its chord is coincident with the imaginary cylindrical surface containing the tips of the needles 20. Again, the channel into which the needles 20 protrude, is bounded by a smooth continuous surface devoid of sharp corners.

In the embodiment shown in FIG. 6, the generatrix of the peripheral surface 26 has a straight central region lying parallel to the rotational axis of the opening roller 5. This central region 27 is joined to the inner surfaces 15 by inclined side regions 28.

I claim:

1. Apparatus for opening fibres in an open-end spinning machine, comprising:

a housing, a recess formed in the housing so as to define a fibre locating surface, an opening roller mounted for rotation in the recess whereby to open fibres from a sliver fed thereto, the opening roller having a peripheral surface cooperating with the fibre locating surface to define therewith a fibre conveying passage, a plurality of teeth protruding from the peripheral surface of the opening roller into the fibre conveying passage such that each of the tips thereof terminates in an imaginary cylindrical surface and equi-distant from the fibre locating surface, wherein the generatrix of the peripheral surface is concave so that the radial distance between the generatrix and the imaginary cylindrical surface is a maximum at a position intermediate the length of the generatrix.

2. Apparatus for opening fibres according to claim 1, wherein the teeth are formed by needles extending through the peripheral surface of the opening roller.

3. Apparatus for opening fibres according to claim 2, wherein the opening roller has a lateral circular flange at each side of the peripheral surface, the lateral flanges having a diameter coincident with the diameter of the imaginary cylindrical surface.

4. Apparatus for opening fibres according to claim 3, wherein the generatrix of the peripheral surface is formed by an arc, the chord of which is coincident with the generatrix of the imaginary cylindrical surface.

5. Apparatus for opening fibres according to claim 3, in which the flanges have inner confronting surfaces defining the width of the fibre conveying passages, wherein the generatrix of the peripheral surface is formed by an arc extending between the inner surfaces and derived from a common radius of curvature.

6. Apparatus for opening fibres according to claim 5, wherein the arc has a chordal depth not greater than 1.5 mm.

7. Apparatus for opening fibres according to claim 6, wherein the arc has a chordal depth of 0.5 mm.

8. Apparatus for opening fibres according to claim 3, wherein the flanges have inner confronting surfaces defining therebetween the width of the fibre conveying passage, and the generatrix of the peripheral surface has an arcuate central region having a first radius of curvature and which conjoins the inner surfaces at each side by further arcuate side regions each having a second radius of curvature, the second radius of curvature being smaller than the first radius of curvature.

9. Apparatus for opening fibres according to claim 3, wherein the flanges have inner confronting surfaces defining therebetween the width of the fibre conveying passage, and the generatrix of the peripheral surface has a straight central region parallel to the rotational axis of the opening roller and inclined side regions which join the straight central region at each side thereof to the inner surfaces.

10. Apparatus for opening fibres according to claim 1, wherein the tips of each of the teeth terminate at an equal distance from the fibre locating surface by an amount not exceeding 0.16 mm.

11. Apparatus for opening fibres according to claim 10, wherein the equal distance of the tips of the teeth from the fibre locating surface is 0.15 mm.

* * * * *